US011242734B2

(12) United States Patent
Larsen

(10) Patent No.: US 11,242,734 B2
(45) Date of Patent: Feb. 8, 2022

(54) FLUID RETRIEVAL USING ANNULAR CLEANING SYSTEM

(71) Applicant: Adam Larsen, Spring, TX (US)

(72) Inventor: Adam Larsen, Spring, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 44 days.

(21) Appl. No.: 16/739,449

(22) Filed: Jan. 10, 2020

(65) Prior Publication Data

US 2021/0215025 A1 Jul. 15, 2021

(51) Int. Cl.
*E21B 43/18* (2006.01)
*E21B 33/12* (2006.01)

(52) U.S. Cl.
CPC ..... *E21B 43/18* (2013.01); *E21B 33/12* (2013.01)

(58) Field of Classification Search
CPC ..... E21B 43/18; E21B 33/12
See application file for complete search history.

(56) References Cited

U.S. PATENT DOCUMENTS

| | | | | |
|---|---|---|---|---|
| 5,033,545 | A | 7/1991 | Sudol | |
| 6,446,720 | B1 * | 9/2002 | Ringgenberg | E21B 21/002 166/250.17 |
| 8,132,621 | B2 * | 3/2012 | Pettinato | E21B 43/124 166/250.01 |
| 2007/0068705 | A1 | 3/2007 | Hosie et al. | |
| 2014/0014350 | A1 | 1/2014 | Sebree | |

FOREIGN PATENT DOCUMENTS

| | | | |
|---|---|---|---|
| WO | 2004009952 | A1 | 1/2004 |
| WO | 2019097259 | A1 | 5/2019 |

OTHER PUBLICATIONS

International Search Report and Written Opinion for International Application No. PCT/US2021/012286; International Filing Date Jan. 6, 2021; dated Apr. 19, 2021; 7 Pages.

* cited by examiner

*Primary Examiner* — Catherine Loikith
(74) *Attorney, Agent, or Firm* — Cantor Colburn LLP

(57) ABSTRACT

A method of drawing a fluid into a wellbore from a formation. The wellbore is separated into a first section and a second section via an annulus closure device, the annulus closure device having a passage therethrough. A pump at a surface location, circulates a circulation fluid in the first section to reduce a pressure in the second section. Reducing the pressure in the second section draws the fluid from the formation into the second section.

14 Claims, 3 Drawing Sheets

FLUID RETRIEVAL USING ANNULAR CLEANING SYSTEM

BACKGROUND

In the resource recovery industry, debris tends to accumulate in a wellbore during drilling operations. A wellbore cleaning operation can be used to clear the debris from the wellbore by circulating cleaning fluid through the wellbore in order to draw the debris into a container. One result of this operation is that cleaning fluid flows into the formation surrounding the wellbore, displacing formation fluids away from the wellbore. These cleaning fluids must then be removed from the wellbore in order to reach the formation fluid. Current methods of removing the cleaning fluid from the formation are time-consuming and costly. Therefore, there is a need to remove cleaning fluid from the formation in a timely manner after a cleaning operation is performed on a wellbore.

SUMMARY

A method of drawing a fluid into a wellbore from a formation, comprising separating the wellbore into a first section and a second section via an annulus closure device, the annulus closure device having a passage therethrough; and circulating a circulation fluid, via a pump at a surface location, in the first section to reduce a pressure in the second section, wherein reducing the pressure in the second section draws the fluid from the formation into the second section.

A system for drawing fluid from a formation, comprising an annulus closure device for separating a wellbore penetrating the formation into a first section and a second section; a passage extending through the annulus closure device to provide fluid communication between the first section and the second section; and a pump at a surface location for circulating a circulation fluid in the first section to reduce a pressure in the second section to draw the fluid from the formation into the second section

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
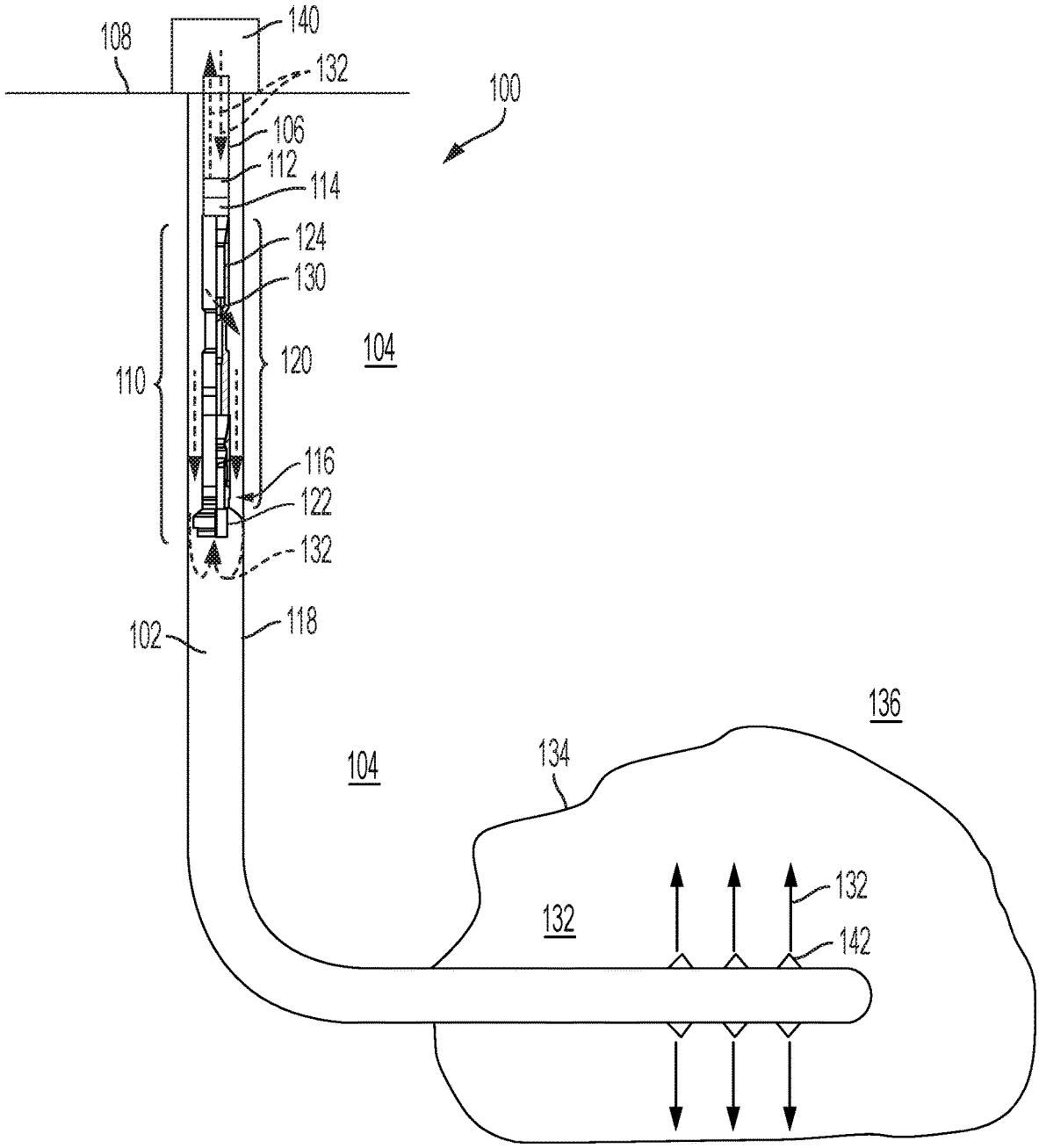
FIG. 1 discloses a wellbore cleaning system disposed in a wellbore.

Referring to FIG. 1, a wellbore cleaning system 100 is disclosed in a wellbore 102 in a formation 104. In one embodiment, the wellbore cleaning system 100 is a Vectored Annular Cleaning System (VACS™) of Baker Hughes, a GE company. The wellbore cleaning system 100 includes a work string 106 extending from a surface location 108 to a downhole location and a pressure control device 110 at a downhole end of the work string 106. In one embodiment, the work string 106 includes a first threaded pipe 112 at its bottom end or downhole end and the pressure control device 110 includes a second threaded pipe 114 at its top end or uphole end. The pressure control device 110 is coupled to the work string 106 by threadingly attaching the first threaded pipe 112 to the second threaded pipe 114. The pressure control device 110 has an outer diameter less than that of the wellbore 102, thereby allowing for the existence of an annulus 116 between the pressure control device 110 and a wall 118 of the wellbore 102.

In one embodiment, the pressure control device 110 includes a fluid circulation device 120 and a valve 122 attached at a bottom end of the fluid circulation device 120. In various embodiments, the valve 122 can be a bottom float valve, a flapper valve or other such valve that allows flow fluid in only one direction. A flow tube 124 runs from one end of the fluid circulation device 120 to an opposite end and attaches to the work string 106 at a top end of the fluid circulation device 120, allowing fluid communication from the downhole location to the surface location 108 via the work string 106. The fluid circulation device 120 also includes a jet 130 for directing fluid from an interior of the work string 106 to the annulus 116.

To clean the wellbore 102, a pump 140 at the surface location 108 circulates a cleaning fluid 132 downhole through the work string 106 from the surface location 108 to the pressure control device 110. The cleaning fluid 132 is then directed from inside the fluid circulation device 120 into the annulus 116 via jet 130. The cleaning fluid 132 circulates downhole through the annulus 116, picking up debris along the way. The valve 122 at the bottom end of the fluid circulation device 120 provides a one-way circulation of fluid into the fluid circulation device 120 in an uphole direction. Cleaning fluid 132 entering the bottom end of the fluid circulation device 120 passes through the fluid circulation device 120, flow tube 124 and work string 106 to return to the surface location. A portion of the cleaning fluid 132 in the fluid circulation device is recirculated in the annulus via the jet 130, down through the annulus 116, into the fluid circulation device 120 via the valve 122, and uphole within the flow tube 124. Debris that enters the fluid circulation device 120 along with the cleaning fluid 132 at the valve 122 is diverted to a debris trap (not shown) in the fluid circulation device 120, thereby cleaning the wellbore.

During the cleaning process, the pressure control device 110 can be moved within the wellbore 102 in order to clean several locations of the wellbore 102, including the horizontal portion shown in FIG. 1. The pressure of the cleaning fluid 132 in the annulus 116 during the cleaning process is greater than a formation pressure in the formation 104, causing the cleaning fluid 132 to migrate into the formation 104, especially at porous locations in the wellbore 102, such as at perforations 142. The pressure of the cleaning fluid 132 thereby pushes a boundary 134 between the cleaning fluid 132 and the formation fluid 136 away from the wellbore 102.

Figure 2:
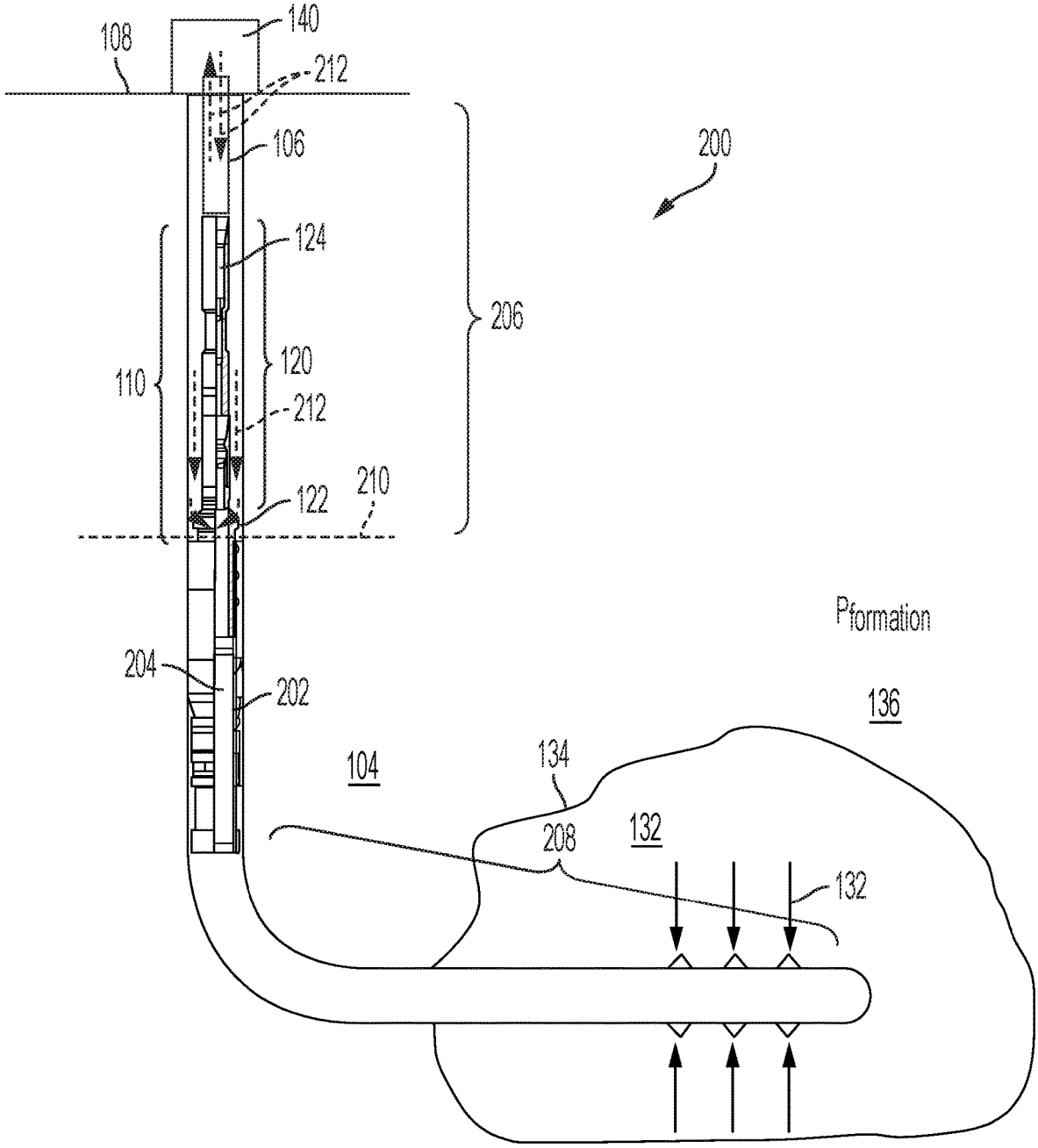
FIG. 2 shows a wellbore restoration system for drawing fluids back into the wellbore from the formation after completion of the wellbore cleaning process of FIG. 1.

FIG. 2 shows a wellbore restoration system 200 for drawing fluids back into the wellbore 102 from the formation 104 after completion of the wellbore cleaning process of FIG. 1. The wellbore restoration system 200 includes the work string 106 and pressure control device 110 of FIG. 1 as well as an annulus closure device, such as packer 202 mechanically coupled to a bottom end of the pressure control device 110. The packer 202 is appended at a downhole end of the valve 122. A passage 204 or conduit extends through the packer 202 and allows fluid to flow from one end of the packer 202 to another end. The passage 204 is in fluid communication with the flow tube 124 of the pressure control device 110. As discussed below a pressure generated in the flow tube 124 is also generated in the second section 208 via the passage 204. Also, fluid retrieved from the formation 104 into the second section 208 flows to the surface location via the passage 204, flow tube 124 and work string 106.

To draw cleaning fluid 132 back into the wellbore 102, the wellbore restoration system 200 is lowered down into the wellbore 102. The packer 202 is activated at a selected location 210 in the wellbore to close of the wellbore 102 at the selected location 210, thereby separating the wellbore 102 into a first section 206 and a second section 208. For purposes of illustration, the first section 206 is an uphole section that extends to the surface location 108 and the second section 208 is an isolated downhole section created by actuating the packer 202. The work string 106 and pressure control device 110 are disposed in the first section 206.

The pressure control device 110 is operated to circulate a circulation fluid 212 through the first section 206 of the wellbore in a circulation pattern similar to the circulation pattern described with respect to FIG. 1. In particular, the pump 140 at the surface location pumps a circulation fluid 212 down through the work string 106 and out of the pressure control device 110 (i.e., the fluid circulation device 120) and into the annulus 116. The circulation fluid 212 then circulates downhole through the annulus 116 and back into the pressure control device 110 at the bottom of the fluid circulation device 120. The circulation fluid 212 is the sent uphole to the surface via the flow tube 124 and work string 106. This circulation pattern reduces a pressure in the flow tube 124 of the pressure control device 110, thereby reducing a pressure $P_2$ in the second section 208. By continued circulation of the circulation fluid in the first section 206, the pressure $P_2$ in the second section 208 can be reduced to a value less than the formation pressure $P_{formation}$, thereby causing the cleaning fluid 132 residing in the formation 104 to be forced back into the second section 208. The cleaning fluid 132 retrieved from the formation is then forced up through the passage 204 in the packer 202 and to the surface via flow tube 124 and work string 106.

As the cleaning fluid 132 residing in the formation 104 is retrieved into the second section 208, the formation fluid 136 previously displaced by the cleaning fluid 132 is drawn toward the second section and eventually into the second section 208. It is understood that although the wellbore restoration system 200 is discussed as retrieving cleaning fluid from a formation, the fluid can be any type of fluid, including cleaning fluid, formation fluid, etc.

Figure 3:
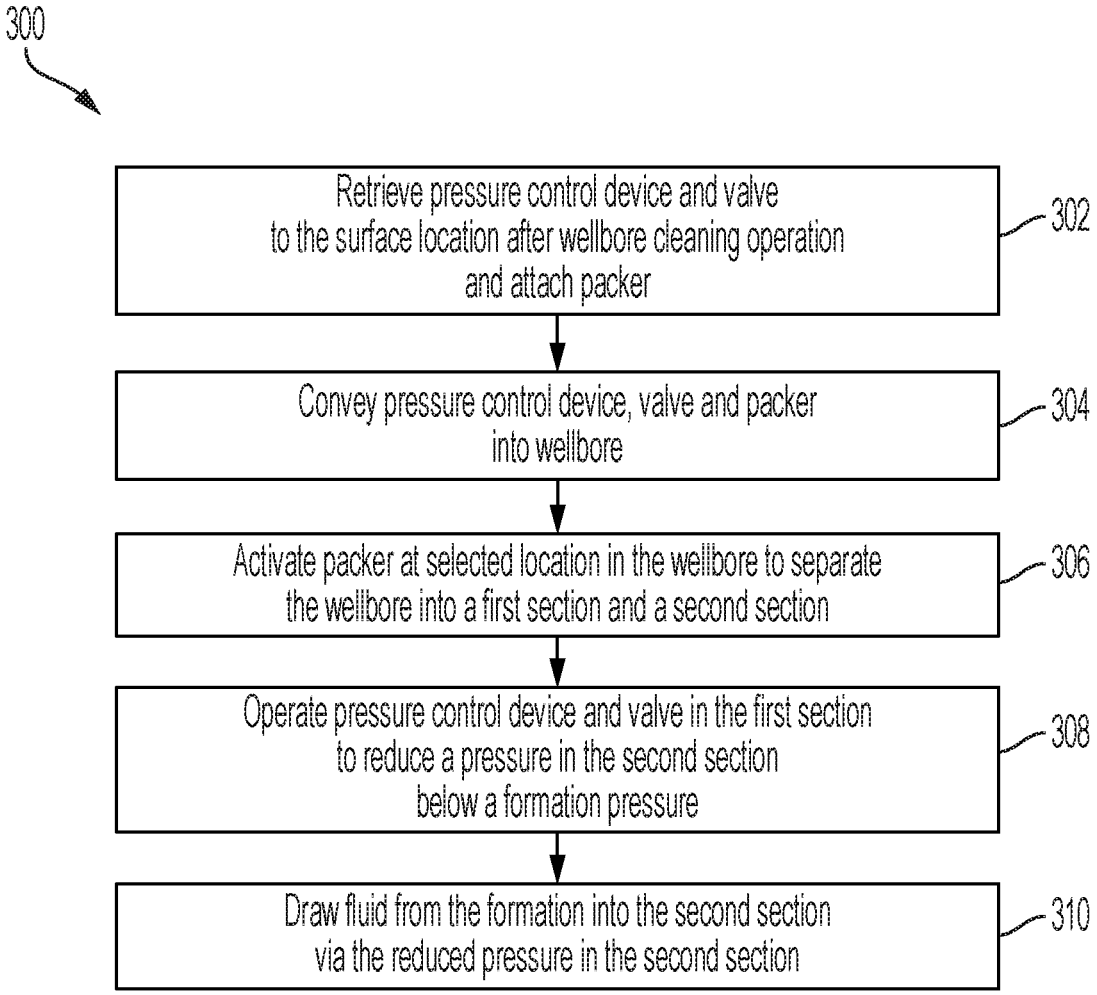
FIG. 3 shows a flow chart illustrating an operation for retrieving cleaning fluid from a formation after a wellbore cleaning operation.

FIG. 3 shows a flow chart 300 illustrating an operation for retrieving cleaning fluid from a formation after a wellbore cleaning operation. In box 302, the fluid circulation device 120 and valve 122 of the wellbore cleaning system 100 are retrieved to the surface and the packer 202 is appended at a downhole end of the valve 122, thereby forming the wellbore restoration system 200. In box 304, the wellbore restoration system 200 is lowered into the wellbore. In box 306, the packer 202 is activated at a selected location in the wellbore 102 to separate the wellbore 102 into a first section 206 and a second section 208. In box 308, the wellbore restoration system is operated in the first section 206 to thereby reduce a pressure in the second section 208. In box 310, the cleaning fluid in the formation 104 is drawn into the second section 208 of the wellbore, through the passage 204 in the packer 202 and uphole via the flow tube 124 and work string 106.

Set Forth Below are Some Embodiments of the Foregoing Disclosure

Embodiment 1

A method of drawing a fluid into a wellbore from a formation, including separating the wellbore into a first section and a second section via an annulus closure device, the annulus closure device having a passage therethrough; and circulating a circulation fluid, via a pump at a surface location, in the first section to reduce a pressure in the second section, wherein reducing the pressure in the second section draws the fluid from the formation into the second section.

Embodiment 2

The method of any prior embodiment, further indicating circulating the circulation fluid in the first section via the pump at the surface location and a fluid circulation device in the first section to reduce a pressure in a flow tube coupled to the passage in the annulus closure device, thereby reducing the pressure in the second section via fluid communication between the flow tube and the passage through the annulus closure device.

Embodiment 3

The method of any prior embodiment, further indicating drawing the fluid from the second section to the surface location via the passage in the annulus closure device and the flow tube.

Embodiment 4

The method of any prior embodiment, wherein the fluid circulation device creates a fluid circulation pattern that draws the fluid from the second section.

Embodiment 5

The method of any prior embodiment, further indicating reducing the pressure in the second section below a formation pressure to draw the fluid into the second section.

Embodiment 6

The method of any prior embodiment, wherein the annulus closure device is a packer coupled to a downhole end of the fluid circulation device.

Embodiment 7

The method of any prior embodiment, wherein the first section is uphole of the second section.

Embodiment 8

The method of any prior embodiment, further indicating removing the fluid circulation device from the wellbore after a wellbore cleaning operation, attaching the annulus closure device to the fluid circulation device and lowering the fluid circulation device and the annulus closure device into the wellbore in order to separate the wellbore into the first section and the second section.

Embodiment 9

A system for drawing fluid from a formation, indicating an annulus closure device for separating a wellbore penetrating the formation into a first section and a second section; a passage extending through the annulus closure device to provide fluid communication between the first section and the second section; and a pump at a surface location for circulating a circulation fluid in the first section to reduce a pressure in the second section to draw the fluid from the formation into the second section.

Embodiment 10

The system of any prior embodiment, further indicating a fluid circulation device in the first section that circulates the circulation fluid in the first section to reduce a pressure in a flow tube in the first section, thereby reducing the pressure in the second section via fluid communication between the flow tube and the passage through the annulus closure device.

Embodiment 11

The system of any prior embodiment, wherein the fluid from the second section is drawn to the surface location via the passage in the annulus closure device and the flow tube.

Embodiment 12

The system of any prior embodiment, wherein the fluid circulation device creates a fluid circulation pattern that draws the fluid from the second section.

Embodiment 13

The system of any prior embodiment, wherein the pump circulates the circulation fluid in the first section to reduce the pressure in the second section below a formation pressure to draw the fluid into the second section.

Embodiment 14

The system of any prior embodiment, wherein the annulus closure device is a packer coupled to a downhole end of the fluid circulation device.

Embodiment 15

The system of any prior embodiment, wherein the first section is uphole of the second section.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A method of drawing a fluid into a wellbore from a formation, comprising:

separating the wellbore into a first section and a second section via an annulus closure device, the annulus closure device having a passage therethrough; and circulating a circulation fluid in the first section via a fluid circulation device in the first section to reduce a pressure in the second section, to draw the fluid from the formation into the second section wherein the fluid circulation device defines an annulus between the fluid circulation device and a wall of the wellbore and includes a flow tube, a jet and a valve that provides one-way circulation from the annulus into the fluid circulation device, and wherein circulating the circulation fluid in the first section includes directing the circulation fluid from inside the fluid circulation device into the annulus via the jet, flowing the circulation fluid downhole through the annulus, into the fluid circulation tube via the valve, and uphole through the flow tube.

2. The method of claim 1, further comprising pumping the circulation fluid via a pump at a surface location to the fluid circulation device to circulate the circulation fluid in the first section to reduce the pressure in the flow tube.

3. The method of claim 2, wherein the flow tube is coupled to the passage, further comprising drawing the fluid from the second section to the surface location via the passage and the flow tube.

4. The method of claim 1, further comprising reducing the pressure in the second section below a formation pressure to draw the fluid into the second section.

5. The method of claim 1, wherein the annulus closure device is a packer coupled to a downhole end of the fluid circulation device.

6. The method of claim 1, wherein the first section is uphole of the second section.

7. The method of claim 1, further comprising removing the fluid circulation device from the wellbore after a wellbore cleaning operation, attaching the annulus closure device to the fluid circulation device, lowering the fluid circulation device and the annulus closure device into the wellbore, and activating the annulus closure device in order to separate the wellbore into the first section and the second section.

8. A system for drawing fluid from a formation, comprising:

a string comprising a fluid circulation device and an annulus closure device at an end of the fluid circulation device for separating a wellbore penetrating the formation into a first section and a second section, the fluid circulation device defining an annulus between the fluid circulation device and a wall of the wellbore, the fluid circulation device including:

a flow tube, a jet that directs a circulation fluid from inside the fluid circulation device into the annulus, and a valve that provides one way circulation from the annulus into the fluid circulation device, wherein fluid circulates downhole in the annulus from the jet to the valve and circulates uphole from the valve through the flow tube to reduce a pressure in the second section to draw the fluid from the formation into the second section; and a passage extending through the annulus closure device to provide fluid communication between the first section and the second section.

9. The system of claim 8, wherein the fluid circulation device includes the flow tube in fluid communication with the passage through the annulus closure device.

10. The system of claim 9, wherein the annulus closure device is a packer coupled to a downhole end of the fluid circulation device.

11. The system of claim 8, wherein the first section is uphole of the second section.

12. The system of claim 8, further comprising a pump at a surface location for circulating the circulation fluid in the first section.

13. The system of claim 12, wherein the fluid from the second section is drawn to the surface location via the passage in the annulus closure device and the flow tube.

14. The system of claim 12, wherein the pump circulates the circulation fluid from the surface location into the first section to reduce the pressure in the flow tube.

* * * * *